US009751726B2

(12) United States Patent
Ketonen et al.

(10) Patent No.: US 9,751,726 B2
(45) Date of Patent: Sep. 5, 2017

(54) LOCKING APPARATUS TO PREVENT MOVEMENT OF AN ELEVATOR CAR

(75) Inventors: Ari Ketonen, Hyvinkää (FI); Jarmo Ahoniemi, Jokela (FI); Marko Malin, Oitti (FI)

(73) Assignee: Kone Corporation, Helsinki (FI)

( * ) Notice: Subject to any disclaimer, the term of this patent is extended or adjusted under 35 U.S.C. 154(b) by 1298 days.

(21) Appl. No.: 13/175,095

(22) Filed: Jul. 1, 2011

(65) Prior Publication Data

US 2011/0290592 A1 Dec. 1, 2011

Related U.S. Application Data

(63) Continuation of application No. PCT/FI2010/000002, filed on Jan. 12, 2010.

(30) Foreign Application Priority Data

Jan. 12, 2009 (FI) ..... 20090010

(51) Int. Cl.
*B66B 11/04* (2006.01)
*B66B 5/00* (2006.01)

(52) U.S. Cl.
CPC ..... *B66B 11/043* (2013.01); *B66B 5/0043* (2013.01); *B66B 5/0087* (2013.01)

(58) Field of Classification Search
CPC ..... B66B 11/04
USPC ..... 187/254, 263; 188/69, 70 R, 73.44, 188/82.74, 265
See application file for complete search history.

(56) References Cited

U.S. PATENT DOCUMENTS

| | | | | |
|---|---|---|---|---|
| 5,133,201 | A | 7/1992 | LaMott et al. | |
| 5,202,539 | A | 4/1993 | Lamb | |
| 5,517,837 | A * | 5/1996 | Wang | 70/226 |
| 5,727,657 | A | 3/1998 | Foelix | |
| 6,966,409 | B2 * | 11/2005 | Wang | 187/290 |
| 7,104,367 | B2 * | 9/2006 | Ferrand et al. | 188/170 |
| 7,392,885 | B2 * | 7/2008 | Wang | 187/263 |
| 2003/0188938 | A1 * | 10/2003 | Li | 188/265 |
| 2005/0051388 | A1 | 3/2005 | Wang | |
| 2007/0170004 | A1 | 7/2007 | Ito | |
| 2009/0173117 | A1 * | 7/2009 | Xavier et al. | 70/228 |
| 2009/0236186 | A1 | 9/2009 | Weiss et al. | |

(Continued)

FOREIGN PATENT DOCUMENTS

| | | | | |
|---|---|---|---|---|
| CH | 680356 | A5 | 8/1992 | |
| DE | 3406633 | A1 * | 9/1984 | B66B 5/16 |
| DE | 10 2005 022 897 | A1 | 11/2006 | |

(Continued)

OTHER PUBLICATIONS

JPO, Patent & Utility Model Gazette Translation, JP2000-191250 A, May 1, 2013, pp. 1-4.*

*Primary Examiner* — William A Rivera
*Assistant Examiner* — Stefan Kruer
(74) *Attorney, Agent, or Firm* — Birch, Stewart, Kolasch & Birch, LLP

(57) ABSTRACT

An elevator and a locking apparatus for preventing rotational movement of the traction sheave of the elevator are provided. The elevator includes at least a hoisting machine provided with a traction sheave, a frame and at least one brake. A holding device is disposed in connection with the hoisting machine, which holding device is arranged to prevent rotational movement of the traction sheave.

9 Claims, 3 Drawing Sheets

(56) References Cited

U.S. PATENT DOCUMENTS

2010/0216604 A1* 8/2010 Chang ..... 482/52

FOREIGN PATENT DOCUMENTS

| | | | |
|---|---|---|---|
| EP | 0725033 | A1 | 8/1996 |
| JP | 5-147890 | A | 6/1993 |
| JP | 2000-191250 | A | 7/2000 |
| JP | 2006-200604 | A | 8/2006 |

* cited by examiner

LOCKING APPARATUS TO PREVENT MOVEMENT OF AN ELEVATOR CAR

CROSS REFERENCE TO RELATED APPLICATIONS

This application is a Continuation of PCT International Application No. PCT/FI2010/000002 filed on Jan. 12, 2010, which claims priority of Application No. FI20090010 filed in Finland on Jan. 12, 2009, all of which are hereby expressly incorporated by reference into the present application.

BACKGROUND OF THE INVENTION

1. Field of the Invention

The present invention relates to an elevator provided with locking apparatus to prevent movement of the elevator car and a locking apparatus to prevent movement of the elevator car.

2. Background of the Invention

In some situations, e.g. when installing an elevator or when the hoisting machine or the brakes of an elevator are being serviced, tested or adjusted, movement of the elevator car and of the counterweight must be prevented in some other way than by means of the operating brakes. It is known that this can be performed by locking the elevator car and/or the counterweight into their positions on the guide rail e.g. by means of a safety gear, a latch or wedges. This is, however, awkward, laborious and time-consuming, and necessitates working in the elevator hoistway. Another prior-art solution is to fix a rope clamp to the hoisting roping, by means of which the hoisting roping is bound fast to e.g. the overhead beam of the hoistway. This is also, however, an awkward and time-consuming solution and requires special tools.

SUMMARY OF THE INVENTION

The purpose of this invention is to eliminate the aforementioned drawbacks and to achieve an elevator provided with locking apparatus to prevent movement of the elevator car as well as an operationally reliable, easy to use, simple and inexpensive locking apparatus to prevent movement of the elevator car.

Some inventive embodiments are also discussed in the descriptive section of the present application. The inventive content of the application can also be defined differently than in the claims presented below. The inventive content may also consist of several separate inventions, especially if the invention is considered in the light of expressions or implicit sub-tasks or from the point of view of advantages or categories of advantages achieved. In this case, some of the attributes contained in the claims below may be superfluous from the point of view of separate inventive concepts. Likewise the different details presented in connection with each embodiment can also be applied in other embodiments. In addition it can be stated that at least some of the subordinate claims can in at least some situations be deemed to be inventive in their own right.

The basic idea of the invention is to prevent unintended movement of the elevator car in servicing work, in connection with installation or in a corresponding situation by acting on the traction sheave. According to the invention, prevention is performed with a separate holding means, of which there can be one or more for each direction of rotation of the traction sheave or instead shared for both directions of rotation. Preferably one holding means is arranged to act on the traction sheave. The balancing in traction sheave elevators is often such that in a normal servicing situation unintended movement can occur in only one direction, in which case the only holding means can be suitably arranged to prevent movement in only this direction. A highly suitable solution is also one in which there is one dedicated holding means for each direction of rotation. Preferably the holding means is a prevention apparatus resting on the frame of the machine, which prevention apparatus can be brought, if necessary, to meet the detent on the traction sheave and thus to prevent rotation of the traction sheave. The holding apparatus can if necessary be made in connection with the brake incorporated in the machine. Functionally the holding apparatus is independent of the brake, whether it is in connection with the brake or separate from the brake. One advantage of the solution according to the invention is that by means of it movement of the elevator car and of the counterweight can be effectively, dependably and safely prevented. Another advantage is that the arrangement is very easy and quick to use, nor does it necessitate awkward working in the hoistway. A further advantage is that the apparatus according to the invention is disposed in connection with the hoisting machine, in which case it is easy to access it when the hoisting machine or the brakes are being serviced. An advantage of the positioning of the apparatus is also that long trailing cables for the electrical monitoring of its space are not needed, because it is disposed near the control system of the elevator. Another advantage is that the apparatus can be used with different car heights. Yet another advantage is that the apparatus is suited for many different elevators and hoisting machines. Another advantage is also that the apparatus is easy to install and it is particularly suited to the modernization of a very old elevator, even if e.g. the car sling and the guide rails were made by different manufacturers. Another advantage is that the apparatus takes little space. A particularly suitable application for the invention is in connection with the machines of gearless elevators. A further advantage is that the solution is inexpensive and simple to implement.

BRIEF DESCRIPTION OF THE DRAWINGS

In the following, the invention will be described in greater detail by referring to an embodiment example and the attached simplified drawings, wherein.

DETAILED DESCRIPTION OF THE PREFERRED EMBODIMENTS

Figure 1:
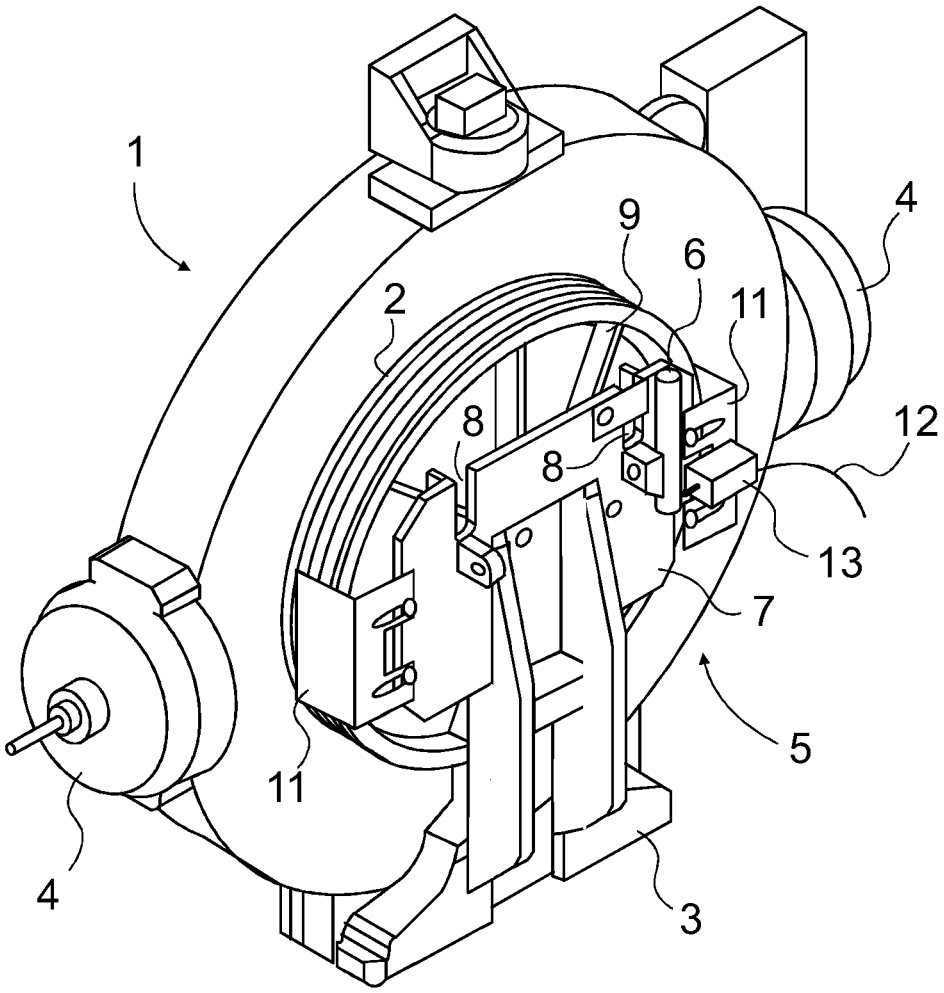
FIG. 1 presents an oblique top view of a hoisting machine of an elevator, in which a locking apparatus according to the invention is used, which locking apparatus is not in the locking position in the figure.
Figure 3:
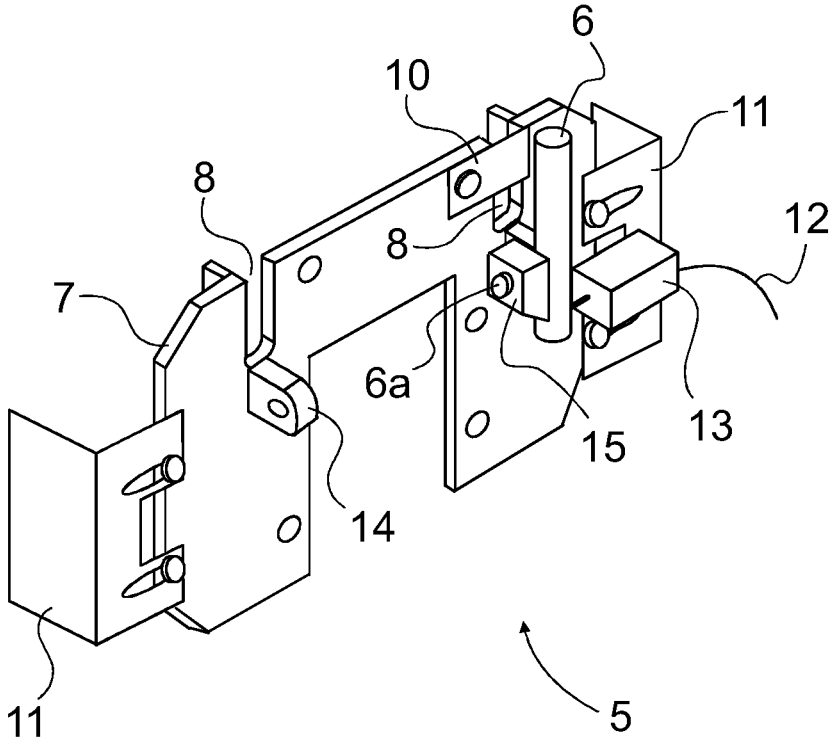
FIG. 3 presents an oblique top view of one locking apparatus according to the invention when detached.

FIG. 1 presents an oblique top view of a hoisting machine 1 of an elevator with its traction sheave 2. The hoisting machine 1 also comprises at least a frame 3, which depending on the model of the elevator is fitted to be fixed e.g. to the floor of the machine room or to the guide rail of the elevator in an elevator without machine room. In a normal situation, when the elevator is not driving, the operating brakes 4 prevent rotational movement of the traction sheave 2. According to the invention, a locking apparatus 5 provided with a holding means 6 as presented in more detail in FIG. 3 is fitted in connection with the frame 3, which locking apparatus is arranged to arrest movement of the elevator car by preventing rotation of the traction sheave 2 by means of shape-locking, when e.g. the hoisting machine 1 or the brakes 4 are being serviced or when the brakes 4 are disconnected for some other reason. The holding means 6 is e.g. a metal rod and it is fixed to its base 7 formed by the frame part of the locking apparatus 5 by means of a hinge 6*a*. In the case according to FIG. 1, the holding means 6 is not in the locking position, so the elevator can move freely.

Figure 2:
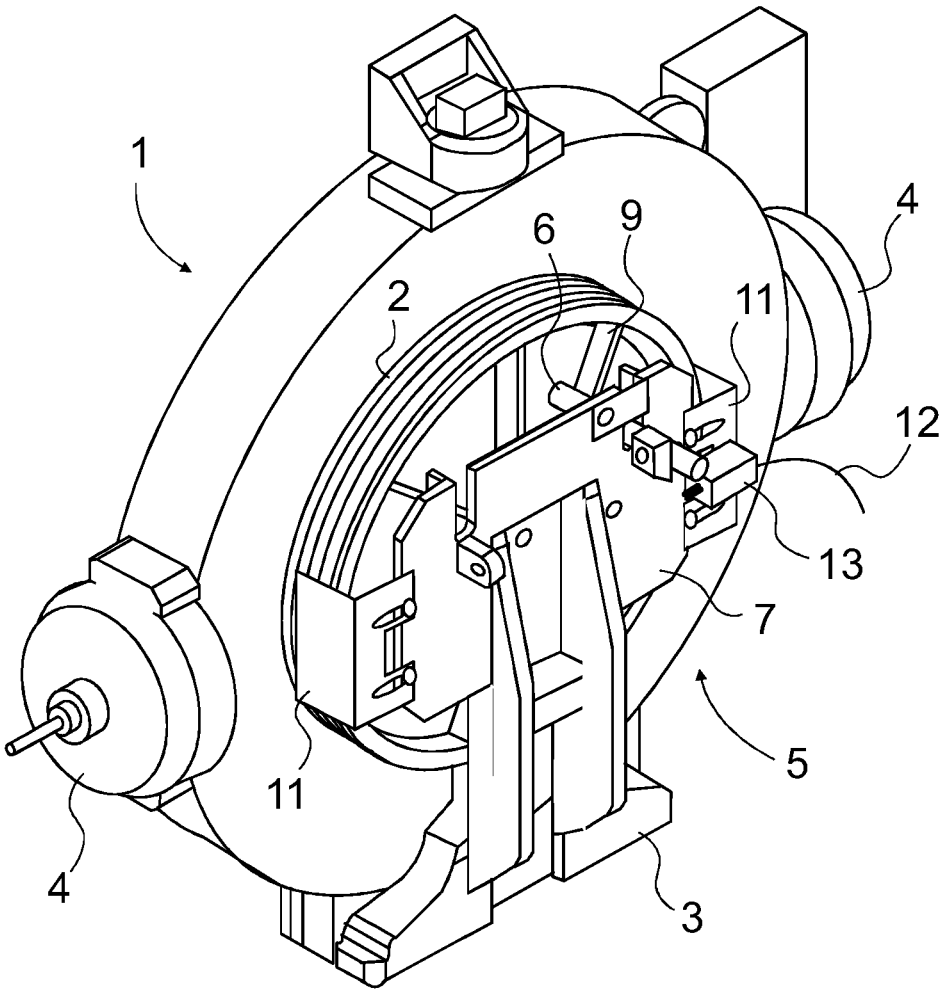
FIG. 2 presents an oblique top view of a hoisting machine of an elevator, in which a locking apparatus according to the invention is used, which locking apparatus is in the locking position in the figure.

FIG. 2 presents an oblique top view of a hoisting machine 1 of an elevator according to FIG. 1, in which the locking apparatus 5 according to the invention is in its locking position. In this case the holding means 6 of the locking apparatus 5 is turned around the hinge 6*a* into its locking position in the groove 8 such that the end of the holding means 6 on the side of the traction sheave 2 extends between the spokes 9 of the traction sheave 2. When the traction sheave 2 starts to rotate the end of the holding means 6 that is between the spokes 9 hits the spoke 9 that functions as a holding detent, in which case the rotational movement of the traction sheave 2, and simultaneously movement of the elevator car, is prevented.

FIG. 3 presents a more detailed oblique top view of one locking apparatus 5 according to the invention. The locking apparatus 5 comprises an essentially plate-like base 7 that functions as a frame part, which base is e.g. a piece cut into a certain shape from a metal plate. The base 7 is provided to be fixed essentially immovably to the frame 3 of the hoisting machine 1.

The locking apparatus 5 also comprises an essentially rod-like holding means 6, which is hinged to the base 7 by means of a hinge 6*a*, as has been described above. The holding means 6 is hinged on the outer surface of the base 7, i.e. on a fixing lug 14 on the surface that points away from the traction sheave 2, which fixing lug comprises a hole essentially in the direction of the plane of the base for the hinge 6*a*. Suitably there are two fixing lugs 14, and in FIG. 3 for the sake of clarity only the free fixing lug 14 is numbered. The holding means 6 is fixed near its first end between the fixing elements 15, which fixing elements 15 press the rod-like part of the holding element 6 tightly between each other. Owing to the viewing angle, only the second fixing means 15 is seen in FIG. 3. Both fixing elements 15 comprise a hole, through which the hinge pin 6*a* can be pushed when installing the holding means 6 into its fixing lug 14. The hinge pin 6*a* of the holding means 6 is locked into its position in the axial direction e.g. by means of cotter pins, nuts or corresponding locking elements.

In addition, the locking apparatus 5 comprises one or more grooves 8, at least on the top edge of the base 7, for the holding means 6, a locking means 10 and also position detector means 13 for the holding means 6. In addition, jump guards 11 are fixed to both side edges of the base 7, which jump guards do not however actually belong to the locking apparatus 5 itself. The jump guards 11 are arranged to prevent the hoisting ropes from jumping off the traction sheave 2.

For preventing movement of the elevator car and rotational movement of the traction sheave 2, the holding means 6 is fitted to turn around the hinge 6*a* in the direction of the plane of the base 7 into the groove 8 on the top edge of the base 7 and thus to meet at its end on the traction sheave 2 side the holding detent 9 on the traction sheave 2, such as e.g. a spoke in the radial direction of the traction sheave or a corresponding cast detent. The holding means 6 can be activated, i.e. can be turned between the spokes of the traction sheave 2, either by hand or e.g. by remote control.

The locking means 10 is hinged to its base 7 next to the groove 8. The locking means 10 is arranged to turn to close the groove 8 and thus to prevent the holding means 6 from jumping from its locking position out of the groove 8. Detector means 13 that detects the position of the holding means are also connected to the holding means 6, which detector means are arranged to give notification when the holding means 6 is in use, so that no attempt is made to drive the elevator when the holding means 6 is between the spokes 9 of the traction sheave 2. The detector means 13 is connected to the control system of the elevator e.g. via conductors 12. A second groove 8 is also made ready on the opposite side of the base 7 in the lateral direction so that the position of the holding means 6 could, if necessary, be changed or so that also a second holding means could be connected to the base 7.

It is obvious to the person skilled in the art that different embodiments of the invention are not limited to the example described above, but that they may be varied within the scope of the claims presented below. Thus, for example, the solution according to the invention can be used in a different type of hoisting machine than that described above.

It is also obvious to the person skilled in the art that the locking apparatus can be fixed to elsewhere in the proximity of the traction sheave than to the hoisting machine itself.

Likewise it is obvious to the person skilled in the art that the locking apparatus and holding means according to the invention can be different to what is described above. The holding means can be e.g. a rod or corresponding element that can be directly pushed inwards or pulled outwards. In this case the holding means is moved e.g. backwards and forwards in the axial direction of the traction sheave.

It is further obvious to the person skilled in the art that the detent of the holding means can be something other than a spoke of the traction sheave, such as e.g. a detent made separately to the traction sheave. This type of detent can also be separate from the traction sheave, e.g. on the brake rim that rotates along with the traction sheave, on the rotor rim that rotates the traction sheave or on similar to it. There can be a number of detents. An easy way to make a number of detents that are separate from the traction sheave is to connect a flange or ring, comprising teeth or holes, to the traction sheave.

It is further obvious to the person skilled in the art that there can be e.g. two holding means instead of one, of which e.g. one can lock the traction sheave in one direction of rotation and the other can lock the traction sheave in the other direction of rotation.

The invention claimed is:

1. A locking apparatus to limit movement of an elevator car, the locking apparatus comprising a base formed by a frame part and a holding device configured to limit movement of the elevator car, wherein the locking apparatus is disposed with respect to a hoisting machine such that the holding device of the locking apparatus is arranged to limit rotational movement of the traction sheave, wherein the holding device pivots about an axis that is perpendicular to a rotational axis of the traction sheave to meet a holding detent on the traction sheave, and wherein the base of the locking apparatus is fixed to the frame of the hoisting machine.

2. The locking apparatus according to claim 1, wherein the holding device is arranged to meet the holding detent on the traction sheave, a flank of the traction sheave comprises additional holding detents, and the holding device is arranged to rest against the holding detent to limit the rotational movement of the traction sheave between the holding detent and one of the additional holding detents that is immediately adjacent to the holding detent.

3. The locking apparatus according to claim 2, wherein the holding device is fixed to the base on the frame by means of a hinge.

4. The locking apparatus according to claim 1, wherein the holding device is arranged to meet the holding detent on the traction sheave by turning around a hinge pin that extends along the axis about which the holding device pivots.

5. The locking apparatus according to claim 1, wherein a detector is connected to the holding device for detecting the locking position of the holding device.

6. The locking apparatus according to claim 1, wherein the holding device is fixed to the base on the frame by means of a hinge.

7. A locking apparatus to limit movement of an elevator car, the locking apparatus comprising a base formed by a frame part and a holding device configured to limit movement of the elevator car, wherein the locking apparatus is disposed with respect to a hoisting machine such that the holding device of the locking apparatus is arranged to limit rotational movement of the traction sheave, wherein the holding device pivots about an axis that is perpendicular to a rotational axis of the traction sheave to meet a holding detent on the traction sheave, and wherein the holding device is fixed to the base on the frame by means of a hinge.

8. A locking apparatus to limit movement of an elevator car, the locking apparatus comprising a base formed by a frame part and a holding device configured to limit movement of the elevator car, wherein the locking apparatus is disposed with respect to a hoisting machine such that the holding device of the locking apparatus is arranged to limit rotational movement of the traction sheave, wherein the holding device pivots about an axis that is perpendicular to a rotational axis of the traction sheave to meet a holding detent on the traction sheave, and wherein the base comprises a groove, into which the holding device is arranged to turn in a locking phase of the traction sheave.

9. A locking apparatus to limit movement of an elevator car, the locking apparatus comprising a base formed by a frame part and a holding device configured to limit movement of the elevator car, wherein the locking apparatus is disposed with respect to a hoisting machine such that the holding device of the locking apparatus is arranged to limit rotational movement of the traction sheave, wherein the holding device pivots about an axis that is perpendicular to a rotational axis of the traction sheave to meet a holding detent on the traction sheave, and wherein the base comprises a locking device, which is arranged to prevent an exit of the holding device from a groove of the base.

* * * * *